US007982149B2

(12) United States Patent
Larsen et al.

(10) Patent No.: US 7,982,149 B2
(45) Date of Patent: Jul. 19, 2011

(54) MECHANICAL ARCHITECTURE FOR DISPLAY KEYBOARD KEYS

(75) Inventors: Glen C. Larsen, Issaquah, WA (US); Michael R. Schweers, Seattle, WA (US); Steven N. Bathiche, Kirkland, WA (US); Andrew Wilson, Seattle, WA (US); Jonathan Knight, Seattle, WA (US); David Zucker, Seattle, WA (US); Kurt A. Jenkins, Sammamish, WA (US)

(73) Assignee: Microsoft Corporation, Redmond, WA (US)

( * ) Notice: Subject to any disclaimer, the term of this patent is extended or adjusted under 35 U.S.C. 154(b) by 272 days.

(21) Appl. No.: 12/240,017

(22) Filed: Sep. 29, 2008

(65) Prior Publication Data

US 2010/0078303 A1 Apr. 1, 2010

(51) Int. Cl.
*H01H 13/83* (2006.01)

(52) U.S. Cl. ..... 200/314; 200/310; 200/313; 200/341; 200/344; 200/345

(58) Field of Classification Search ..... 200/5 A, 200/517, 310, 313, 314, 341, 344, 345; 341/22, 341/27; 345/168–170; 400/490–496
See application file for complete search history.

(56) References Cited

U.S. PATENT DOCUMENTS

| | | | | | |
|---|---|---|---|---|---|
| 4,017,700 | A * | 4/1977 | West | ..... | 200/314 |
| 4,060,703 | A | 11/1977 | Everett, Jr. | | |
| 4,251,723 | A * | 2/1981 | Speidel et al. | ..... | 250/229 |
| 4,378,478 | A | 3/1983 | Deeg | | |
| 4,536,625 | A * | 8/1985 | Bebie | ..... | 200/5 A |
| 5,268,545 | A | 12/1993 | Bruner | | |
| 5,285,037 | A * | 2/1994 | Baranski et al. | ..... | 200/314 |
| 5,434,377 | A * | 7/1995 | Martin et al. | ..... | 200/314 |
| 5,828,015 | A | 10/1998 | Coulon | | |
| 6,060,672 | A * | 5/2000 | Sugihara | ..... | 200/61.1 |
| 6,218,966 | B1 | 4/2001 | Goodwin et al. | | |
| 6,224,279 | B1 | 5/2001 | Nielsen et al. | | |
| 6,331,850 | B1 | 12/2001 | Olodort et al. | | |
| 6,400,357 | B1 | 6/2002 | Chao | | |
| 6,522,147 | B1 * | 2/2003 | Pickard et al. | ..... | 324/414 |
| 6,686,549 | B2 * | 2/2004 | Douzono et al. | ..... | 200/341 |
| 6,809,278 | B2 * | 10/2004 | Tsubaki | ..... | 200/341 |
| 6,972,699 | B2 | 12/2005 | Olodort et al. | | |
| 7,026,563 | B2 * | 4/2006 | Miyako et al. | ..... | 200/310 |
| 7,485,821 | B2 * | 2/2009 | Martin | ..... | 200/310 |
| 7,635,820 | B2 * | 12/2009 | Shen et al. | ..... | 200/314 |
| 2004/0256210 | A1 * | 12/2004 | Morita et al. | ..... | 200/344 |
| 2007/0036603 | A1 | 2/2007 | Swoboda | | |

OTHER PUBLICATIONS

"The Best Keyboard Apple Ever Made" Rises Again, http://www.matias.ca/tactilepro/.
"Computer Questions: How Computer Keyboards Work", http://www.essortment.com/hobbies/howcomputerkey_scqh.htm.

* cited by examiner

*Primary Examiner* — Michael A Friedhofer

(57) ABSTRACT

Mechanical architecture for providing maximum viewing area on key button tops of keys for a user input device. The viewing area is for the display of information on the key buttons, and also includes tactile feedback similar to standard laptop keyboards, all using low cost manufacturing methods such as injection molding. The architecture optimizes an aperture through the core of the key switch assembly in order to project an image through the aperture and onto the display area of the key button. The architecture relocates in at least one embodiment the tactile feedback mechanism (e.g., dome assembly) out from underneath the key button to the perimeter or side of the key switch assembly. The architecture finds particular application to input devices such as keyboards, game pods, data entry device, etc., that operate in combination with an optical surface (e.g., wedge lens).

20 Claims, 18 Drawing Sheets

MECHANICAL ARCHITECTURE FOR DISPLAY KEYBOARD KEYS

BACKGROUND

The most popular input device is the keyboard, keypad, or the like, which is employed on cell phone, PDAs, portable computers, and desktop computer, for example. The key button is stamped with alphabetic, numeric, and other nomenclature, as well as for function keys. However, the functions assigned to the function keys are typically dependent on the computing context and are oftentimes assigned different functions for different contexts.

The ability to provide more flexibility in manufacturing and among the many different users was addressed by putting small liquid crystal display (LCD) screens on the tops of the individual keys. However, this presents many new problems by providing each of the keys with the LCD screen, LCD driver, LCD controller, and electronics board to integrate these components. Moreover, electronics boards need to be placed at the top of each of the mechanically actuated keys and connected to a system data bus via a flexible cable to accommodate the electrical connection during key travel.

Additionally, each of the keys must be individually addressed by a master controller to provide the electrical signals for controlling the LCD images for each of the key tops where the image is formed. This additional complexity impedes the mass production capability and low cost desired in a highly competitive marketplace. The LCD screens are flat, thereby preventing the design of concave or otherwise shaped keypads to provide tactile feedback to the user.

SUMMARY

The following presents a simplified summary in order to provide a basic understanding of some novel embodiments described herein. This summary is not an extensive overview, and it is not intended to identify key/critical elements or to delineate the scope thereof. Its sole purpose is to present some concepts in a simplified form as a prelude to the more detailed description that is presented later.

Disclosed is a mechanical architecture for providing maximum viewing area on the key button tops for the display of information, and with a tactile sense similar to standard laptop keyboards, all using low cost manufacturing methods such as injection molding. The architecture optimizes the aperture through the core of the key switch assembly in order to project an image through the aperture and onto the display area of the key button. The architecture moves the tactile feedback mechanism (e.g., dome assembly) out from underneath the key button to the perimeter or side of the key switch assembly.

The mechanical architecture finds particular application to input devices such as keyboards, game pods, data entry devices, etc., that operate in combination with an optical surface (e.g., wedge lens). The mechanics can include a movement assembly such as a scissor key structure or a hollow key stem silo structure, and a window (display area) in the top of the key button where the display area receives light transmitted up from the optical surface between the movement assemblies.

Additionally, the architecture includes a key activation mechanism (e.g., key-down detection) that can be an optically sensed rigid post attached to the key button, an optically sensed marker on the bottom of dome assembly, or an electromechanical solution that includes a multi-layer plastic sheet (e.g., polyester) with contact key switches. Tactile feedback can be provided using a single rubber dome assembly per key, where the dome assembly is offset for scissor key structures. The dome assemblies can also be mass produced on a dome sheet for multiple keys. Other alternative approaches to an elastomeric dome for providing tactile feedback are possible such as by using a movable shock absorber between the scissor assembly legs, bulk solid compression or, metal or plastic spring, for example. Wire anti-sway bars can be provided to prevent key twist on large keys (e.g., space bar, enter, caps lock, etc.). The architecture also includes a sealing structure that prevents debris, liquids, oil, etc., from entering the key and display area, and seals individual keys.

The use of the display of information (e.g., characters) on the key buttons offers flexibility such as legend morphing, and general display through the keys. The key switch mechanism facilitates the enhanced display capability, and detects touch to the display surface thereby enabling gestures on the display surface. Extending gesturing further, the keyset may be temporarily removed or entirely eliminated in order to gesture directly on a full-keyboard sized display surface.

To the accomplishment of the foregoing and related ends, certain illustrative aspects are described herein in connection with the following description and the annexed drawings. These aspects are indicative of the various ways in which the principles disclosed herein can be practiced, all aspects and equivalents of which are intended to be within the scope of the claimed subject matter. Other advantages and novel features will become apparent from the following detailed description when considered in conjunction with the drawings.

DETAILED DESCRIPTION

Figure 1:
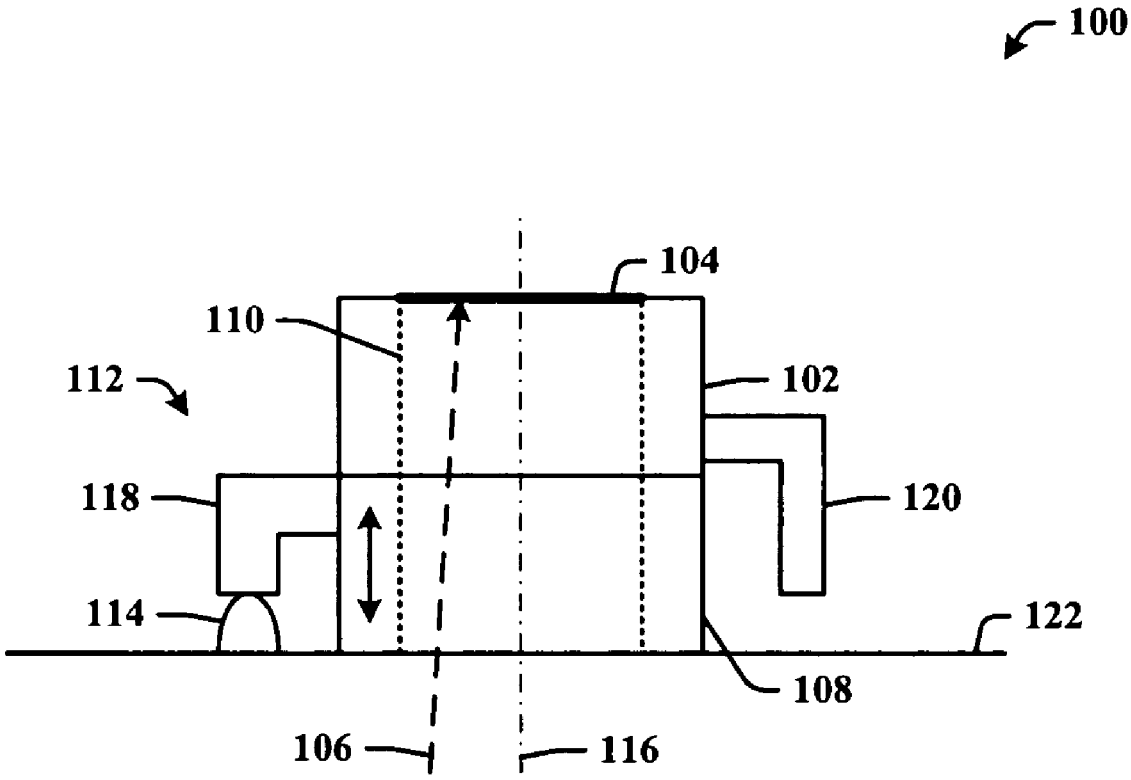
FIG. 1 illustrates a key switch assembly for display-type keys for user input devices.

The disclosed mechanical architecture provides maximum viewing area on the key button tops for the display keyboards, keypads, game controllers and the like, that operate in combination with an optical surface (e.g., a wedge lens), and with tactile feel similar to standard laptop keyboards. The mechanics can include a movement assembly such as a scissor key structure or a hollow key stem silo structure that defines an internal aperture through which an image can be projected onto the key button top for viewing. The architecture moves the tactile feedback mechanism (e.g., dome assembly) out from underneath the key button to the perimeter or side of the key switch assembly.

Reference is now made to the drawings, wherein like reference numerals are used to refer to like elements throughout. In the following description, for purposes of explanation, numerous specific details are set forth in order to provide a thorough understanding thereof. It may be evident, however, that the novel embodiments can be practiced without these specific details. In other instances, well known structures and devices are shown in block diagram form in order to facilitate a description thereof. The intention is to cover all modifications, equivalents, and alternatives falling within the spirit and scope of the claimed subject matter.

FIG. 1 illustrates a key switch assembly 100 for display-type keys for user input devices. The switch assembly 100 includes, generally, a key button 102 (represented generally as a block) having a display portion 104 onto which light 106 is directed for viewing display information, such as letters, characters, images, video, other markings, etc. The display portion 104 can be a separate piece of translucent or transparent material embedded into the top of the key button 102 that allows the light imposed on the underlying surface of the display portion 104 to be perceived on the top surface of the display portion 104.

The switch assembly 100 also includes a movement assembly 108 (represented generally as a block) in contact with the key button 102 for facilitating vertical movement of the key button 102. The movement assembly 108 defines an aperture 110 through which the light 106 is projected onto the display portion 104. Additionally, the structure of the key button 102 can also allow the aperture 110 to extend into the key button structure; however, this is not a requirement, since alternatively, the key button 102 can be a solid block of material into which the display portion 104 is embedded; the display portion extending the full height of the key button 102 from the top surface to the bottom surface.

A feedback assembly 112 of the switch assembly 100 can include an elastomeric (e.g., rubber, silicone, etc.) dome assembly 114 that is offset from a center axis 116 of the key button 102 and in contact with the movement assembly 108 for providing tactile feedback to the user. It is to be understood that multiple dome assemblies can be utilized with each key switch assembly 100. The feedback assembly 112 may optionally include a feedback arm 118 that extends from the movement assembly 108 and compresses the dome assembly 114 on downward movement of the key button 102.

The switch assembly 100 also includes contact arm 120 that enters close proximity with a surface 122 when the key button 102 is in the fully down mode. When in close proximity with the surface 122, the contact arm 120 can be sensed, indicating that the key button 102 is in the fully down position. The contact arm 120 can be affixed to the key button 102 or the movement assembly 108 in a suitable manner that allows the fully down position to be sensed when in contact with or sufficiently proximate to the surface 122.

The structure of switch assembly 100 allows the projection of an image through the switch assembly 100 onto the display portion 104. It is therefore desirable to move as much hardware as possible away from the center axis 116 to provide the optimum aperture size for light transmission and image display. In support thereof, as shown, the feedback assembly 112 can be located between the keys and outside the general footprint defined by the key button 102 and movement assembly 108. However, it is to be understood that other structural designs that place the feedback assembly closer to the footprint or in the periphery of the footprint fall within the scope of the disclosed architecture. Moreover, it is to be understood that the feedback assembly 112 can be placed partially or entirely in the aperture 110 provided there is suitable space remaining in the aperture 110 to allow the desired amount of light 106 to reach the display portion 104.

Figure 2:
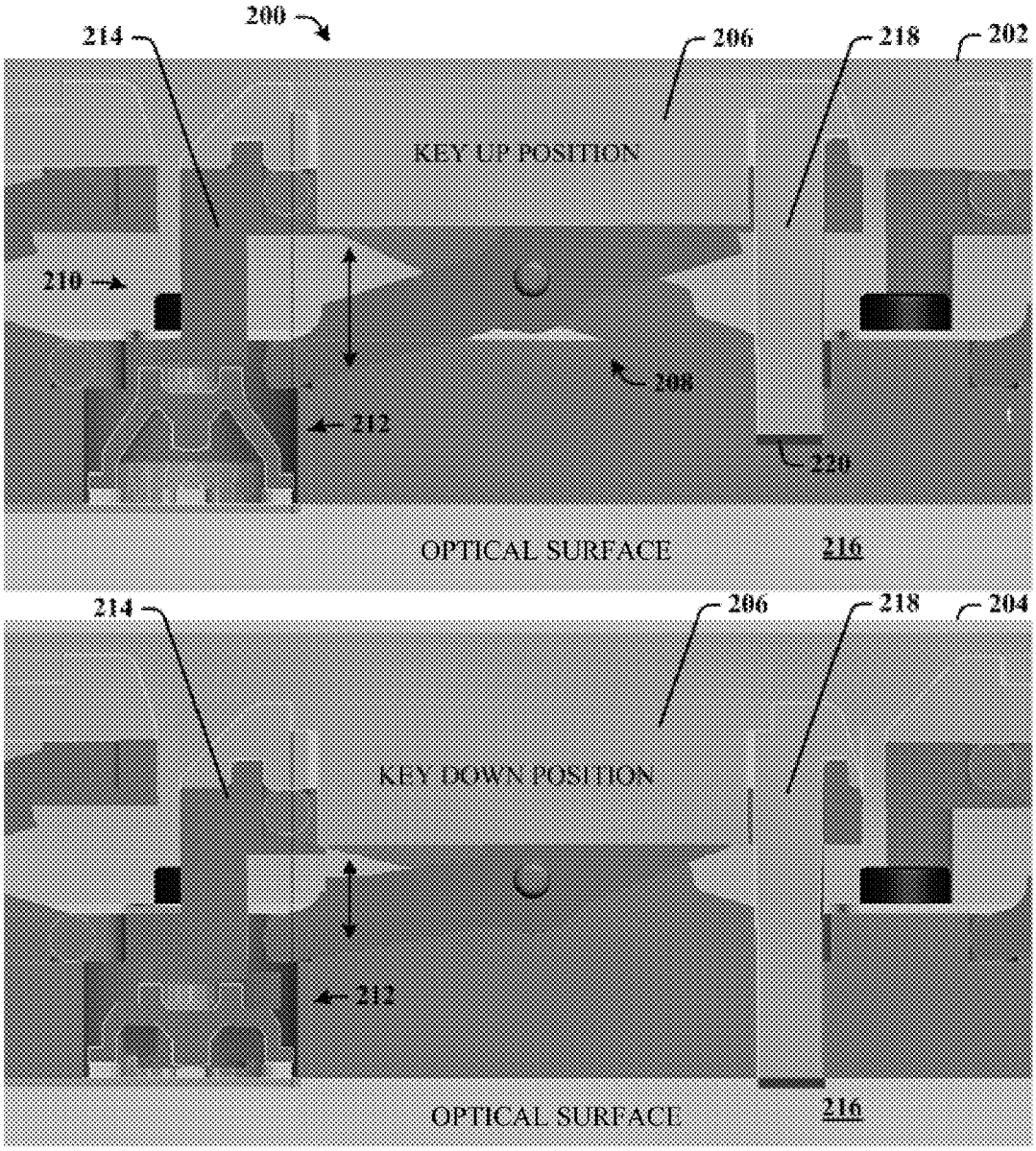
FIG. 2 is a side view of an exemplary scissor-type key switch assembly in an up key position view and a down key position view.

FIG. 2 illustrates a side view of an exemplary scissor-type key switch assembly 200 in an up key position view 202 and a down key position view 204. As shown in the up view 202, the switch assembly 200 includes a key button 206, a scissor-type movement assembly 208 in contact with (or affixed to) the key button 206, and a feedback assembly 210 (for tactile feedback) that includes a dome assembly 212 and a feedback arm 214 that compresses the dome assembly 212 when the key button 206 is moving in a downward motion. The dome assembly 212 is under the key frame between the keys, rather than of under the center of the key as in conventional implementations. In one embodiment, the inside center stub of the dome can be used with a reflective sensing material to be sensed as the material contacts an optical display/detection surface 216. Alternatively, a grid of traditional plastic sheets (e.g., polyester) can be utilized, but with cutouts for the key displays.

In the up view 202, the dome assembly 212 is shown in the fully relaxed position. The switch assembly 200 is positioned over the optical display/detection surface 216 via which light is communicated and directed upward through the movement assembly 208 to underside of the key button 206 (the display portion) for viewing from the top of the key button 206.

The switch assembly 200 further includes a contact arm 218 affixed to the key button 206 such that in the up position, the contact arm 218 does not contact the optical surface 216, but when in the fully down position, the contact arm 218 contacts the optical surface 216. A sensing end 220 (which can be an affixed pad, reflective coating, polished end, etc.) is applied to a lower surface of the contact arm 218 such that the sensing end 220 contacts the optical surface 216 when the key button 206 is in the fully down position. The sensing end 220 can be reflective such that light reflected from end 220 via the optical display/detection surface 216 indicates that the key button 206 is in the fully down position; otherwise, the key button 206 is in the up position.

In the key down view 204, the key button 206 is in the fully down position, such that the feedback arm 214 compresses the dome assembly 212 thereby providing tactile feedback for the key button 206.

The optical display/detection surface 216 can be a display that transmits light through the surface 216 such that light eventually exits the display/detection surface under the key button 206 and is directed upward to the underside of the key button 206 to the display portion (not shown). Light impinged on the underside of the key button 206 then exits the top side of the key button 206 thereby presenting an image on the top surface for viewing by the user.

Figure 3:
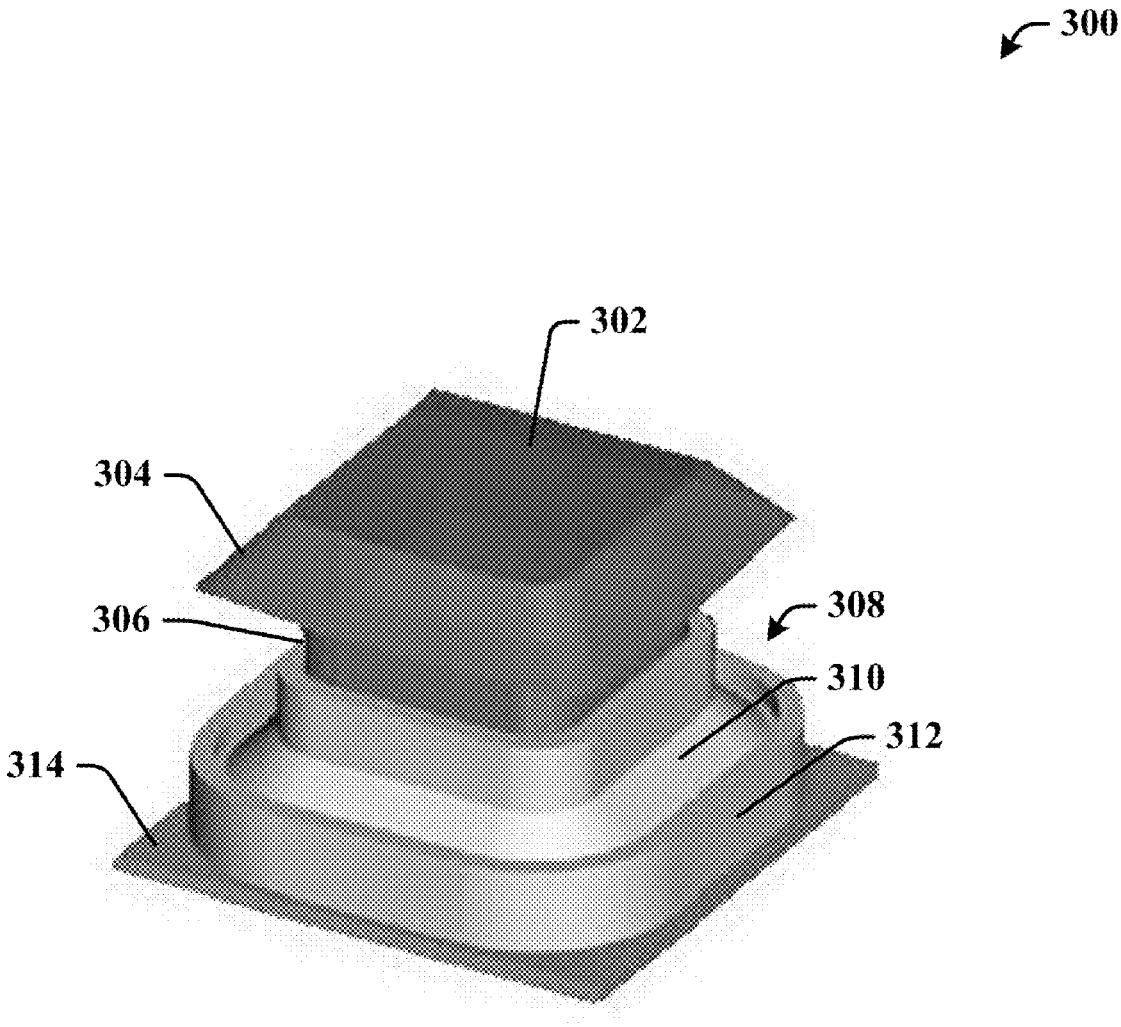
FIG. 3 is an oblique view of an alternative silo switch assembly that employs a silo-stem arrangement with external dome.

FIG. 3 illustrates an oblique view of an alternative stem/silo switch assembly 300 that employs a stem/silo arrangement with an external dome. The stem/silo switch assembly 300 provides a display area 302 in a key button 304 similar to the display portion 104 of the switch assembly 100 of FIG. 1. The key button 304 affixes to a key stem 306 that facilitates vertical movement of the button 304. The key stem 306 travels outside a key silo 402 (not visible here, but visible in FIG. 4) and inside a dome assembly 308. The dome assembly 308 includes an elastomeric dome 310 and may include a support rim 312 into which dome 310 is positioned. When the button 304 is pressed downward, the stem 306 moves the dome 310 downward (compresses) thereby providing tactile feedback. A web 314 extending horizontally from the middle of the switch assembly 300 is a sealing film that prevents dust, liquids, oils, etc., from penetrating the keyboard surface and entering the internal components (substrate layers, orifices, etc.) of the keyboard or keypad in which the stem/silo switch assembly 300 is utilized. Other embodiments are possible, such as architecture with the elastomeric dome 310 within the key stem 306, which is within the key silo 402.

Figure 4:
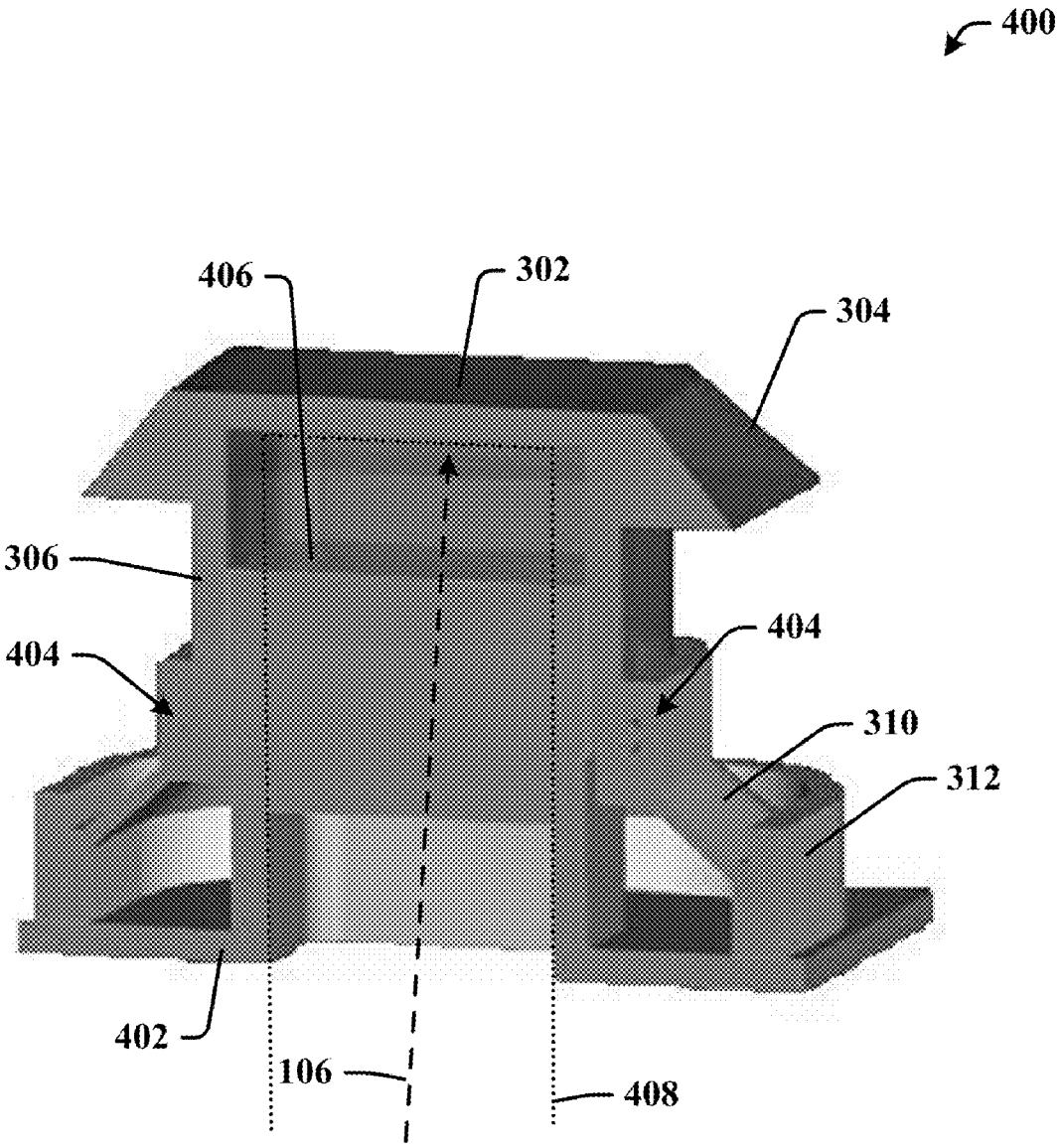
FIG. 4 is an oblique cross-sectional view of the silo switch assembly of FIG. 3.

FIG. 4 illustrates an oblique cross-sectional view of the stem/silo switch assembly 300 of FIG. 3. Here, the key stem 306 travels on the outside of a silo base 402. The key stem 306 is captured inside the dome 310 at a capture point 404 that extends around the outside surface of the key stem 306 such that downward travel of the key stem 306 forces downward travel of the dome 310 until the underside of the dome 310 meets the upper surface of the silo base 402. Here, the silo base 402 and key stem 306 define an aperture 408 through which light 106 travels to the display area 302. An optional part 406 can be an optical element (e.g., a collimating lens) that permits light 106 to travel therethrough to the display area 302 of the key button 304.

Figure 5:
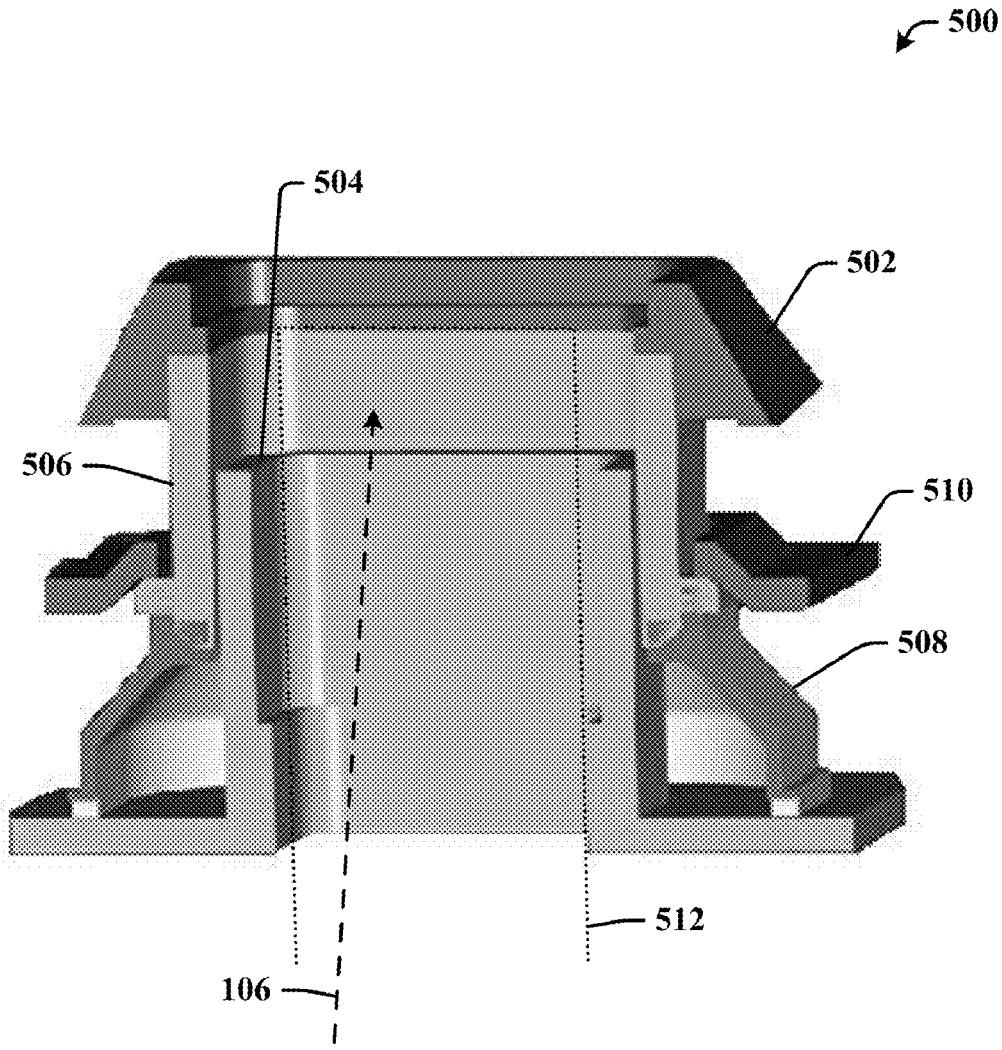
FIG. 5 is an oblique cut-away view of an alternative silo switch assembly.

FIG. 5 illustrates an oblique cut-away view of an alternative stem/silo switch assembly 500. The stem/silo switch assembly 500 includes a key button 502, a key silo base 504, a key stem 506, a dome assembly 508, and a travel stop 510. The key stem 506 affixes to the key button 502 such that downward travel of the key button 502 causes the key stem 506 to compress the dome assembly 508. The travel stop 510 limits upward travel of the key stem 506 and prevents the key stem 506 from disconnecting from the switch assembly 500. The interior of the stem/silo switch assembly 500 as defined by the silo base 504 and key stem 506 form an aperture 512 though which the light 106 can be directed to the display area (not shown) of the key button 502.

Figure 6:
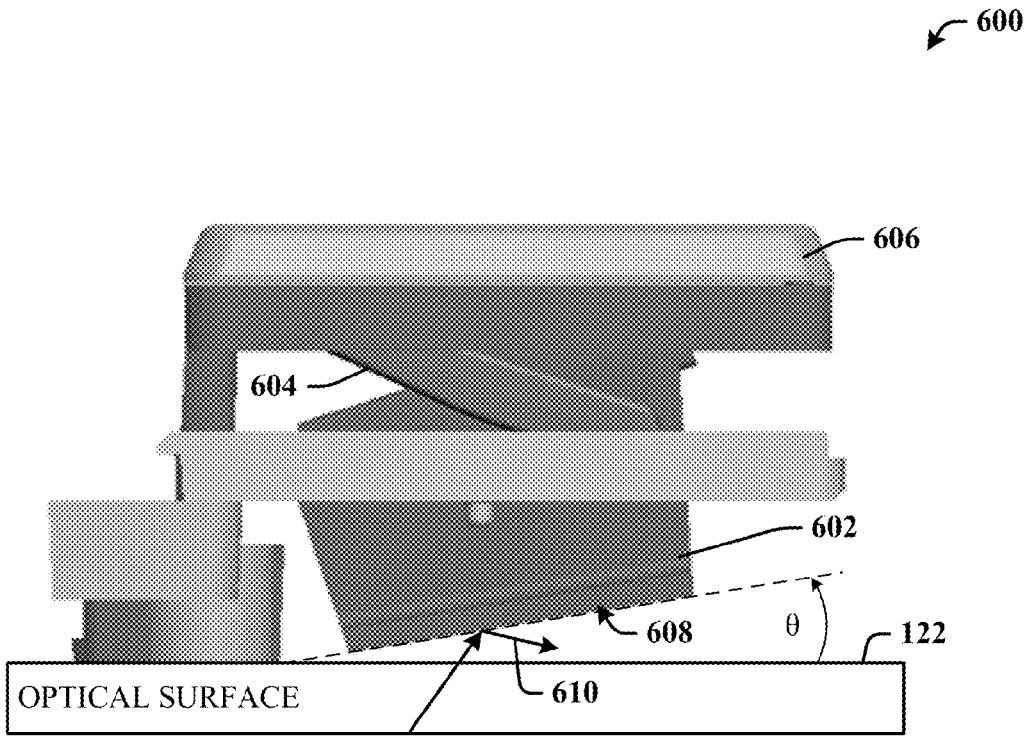
FIG. 6 is a side view of an alternative switch assembly in an up position that employs an optical paddle for position detection.

FIG. 6 illustrates a side view of an alternative switch assembly 600 in an up position that employs an optical paddle 602 for position detection. The optical paddle 602 is attached to a scissor assembly 604 for vertical movement and pivots as a key button 606 is pressed downward. The optical paddle 602 includes a detection surface 608 that is sensed to determine the position of the key button 606 relative to the optical display/detection surface 122. When the key button 606 is in the up position, the reflective paddle surface 608 is at an angle θ from the optical surface 122, and the optical signal 610 is "weak" since specular light from the paddle surface 608 is not sufficiently reflected back into the optical surface 122 for detection processing.

Figure 7:
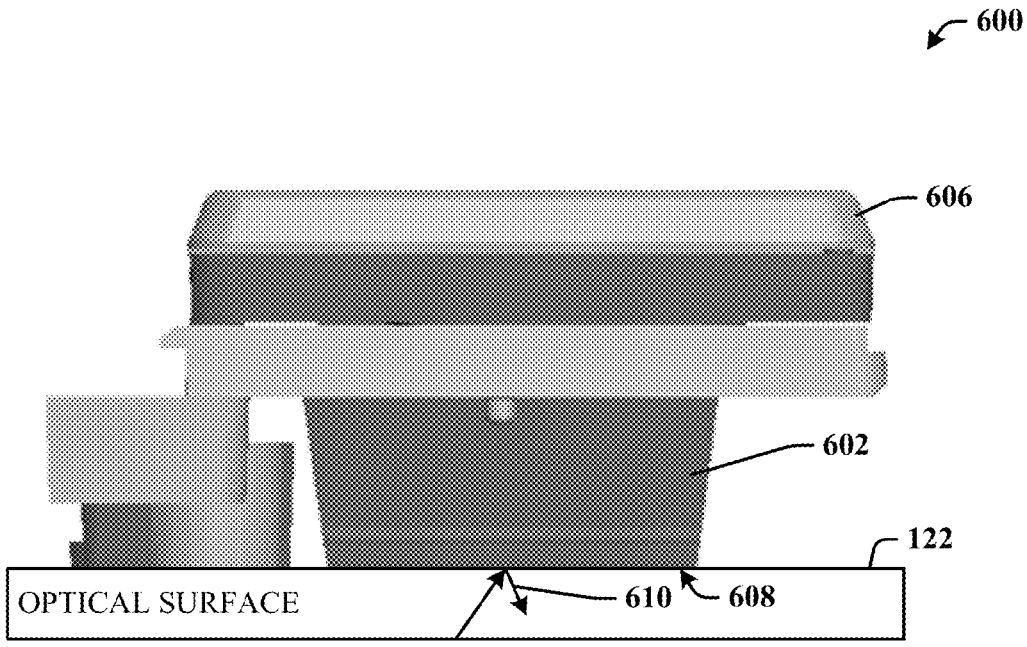
FIG. 7 is a side view of the alternative switch assembly in a down position where the optical paddle surface is in contact with the optical surface for position detection.

FIG. 7 illustrates a side view of the alternative switch assembly 600 in a down position where the optical paddle surface is in contact with the optical surface 122 for position detection. When the angle θ decreases and the distance between the reflective paddle surface 608 and the optical display/detection surface 122 decreases a "stronger" optical signal than the weaker optical signal is detected indicating the corresponding change in the up position and the down position of the key button 606 (the signal-to-noise ratio has improved). A detector on the optical surface 122 can sense the signal difference, which can then be interpreted as an up position or a down position. Note that it is possible to swap the paddle orientation, which causes a strong reflected signal with the key position (the geometry of the paddle can be defined such that the strong signal is received in the up position, and the weak signal is received in the down position).

Figure 8:
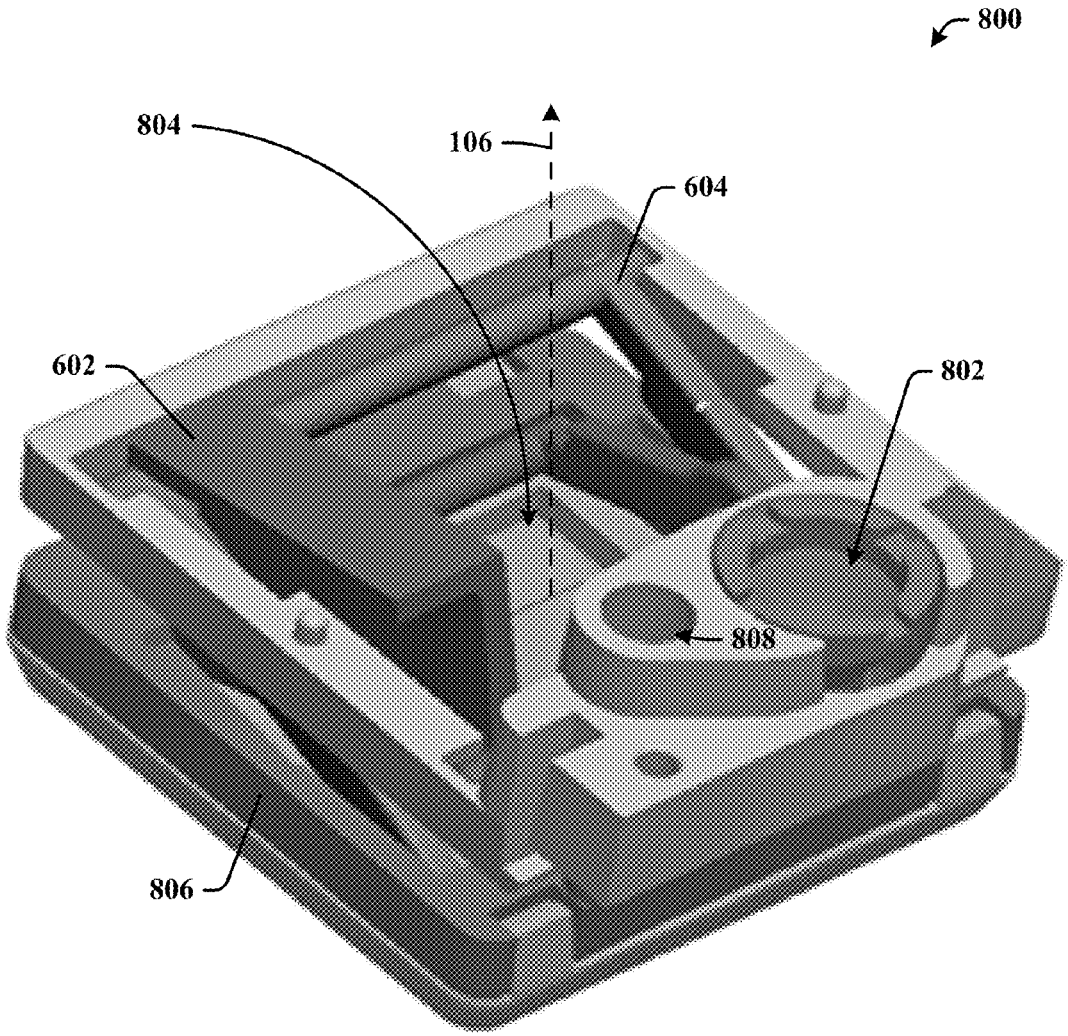
FIG. 8 is an oblique view of an alternative switch assembly in an up position and that employs the optical paddle as part of the scissor assembly.

FIG. 8 illustrates an oblique view of an alternative switch assembly 800 in an up position and that employs the optical paddle 602 as part of the scissor assembly 604. The switch assembly 800 also includes a dome port 802 into which a button arm (not shown) extends to contact the elastomeric dome assembly (not shown). Notice that the scissor assembly 604 is structured along the periphery of the switch assembly 800 thereby defining an aperture 804 through which the light 106 can be received and imposed on the key button (not shown). The dome port 802 and underlying dome assembly (not shown) is located away from the aperture 804 to allow as much light as possible through the aperture 804 to the display area of the key button. The key button can snap on to a movable frame 806 that moves up and down with the corresponding movement of the key button. Feature 808 is an alternative key detection scheme that contains an optical detection post similar to the optical paddle 602 (but without pivoting), which comes straight down in the feature 808 to be in proximity of the optical display/detection surface. Additionally, feature 808 is not in a movable part. An optical post 900 of FIG. 9, traveling within feature 808, is attached to the movable part, such as feedback arm 214 of FIG. 2.

Figure 9:
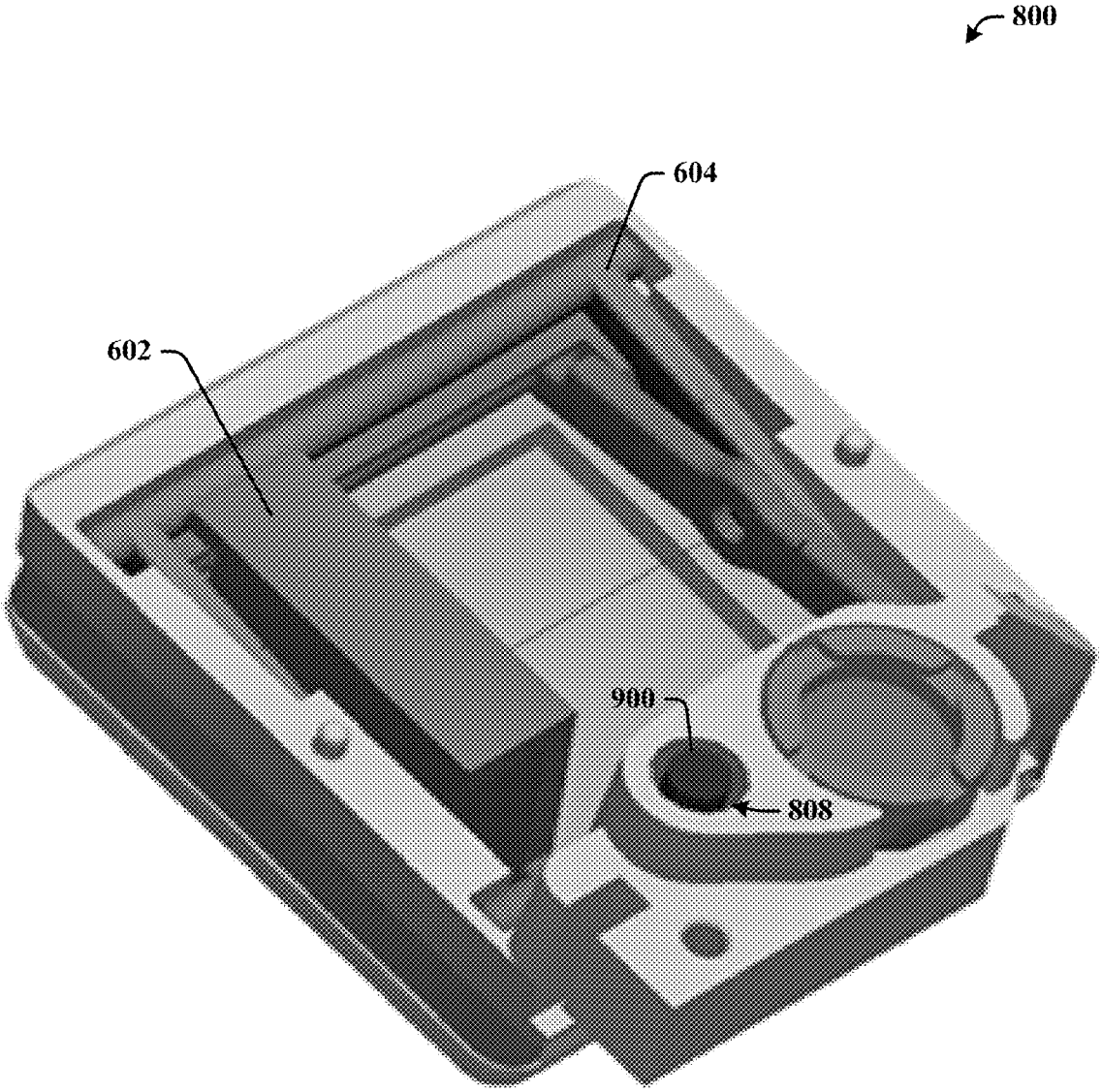
FIG. 9 is an oblique view of the alternative switch assembly in a down position and that employs the optical paddle as part of the scissor assembly.

FIG. 9 illustrates an oblique view of the alternative switch assembly 800 in a down position and that employs the optical paddle 602 as part of the scissor assembly 604. Here, the reflective paddle surface contacts the optical surface (not visible) thereby facilitating a strong optical signal that is interpreted to indicate the key button is in the down position. The feature 808 shows the optical post 900 that not only guides the vertical travel of the assembly components, but can also limit the downward movement of the switch assembly.

Figure 10:
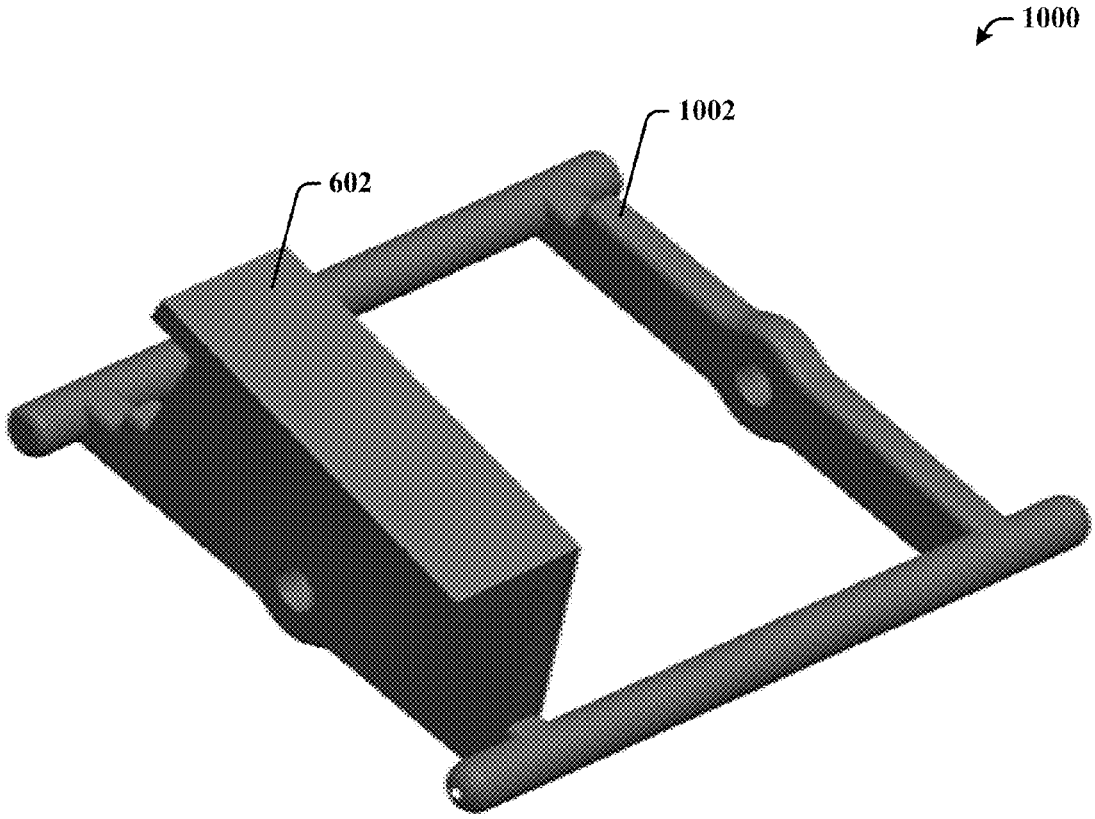
FIG. 10 is an oblique view that shows the optical paddle and an associated scissor member.

FIG. 10 is an oblique view that shows the optical paddle 602 and an associated scissor member 1002. The scissor member 1002 is one of the parts of the overall scissor assembly shown in FIG. 8, for example.

Figure 11:
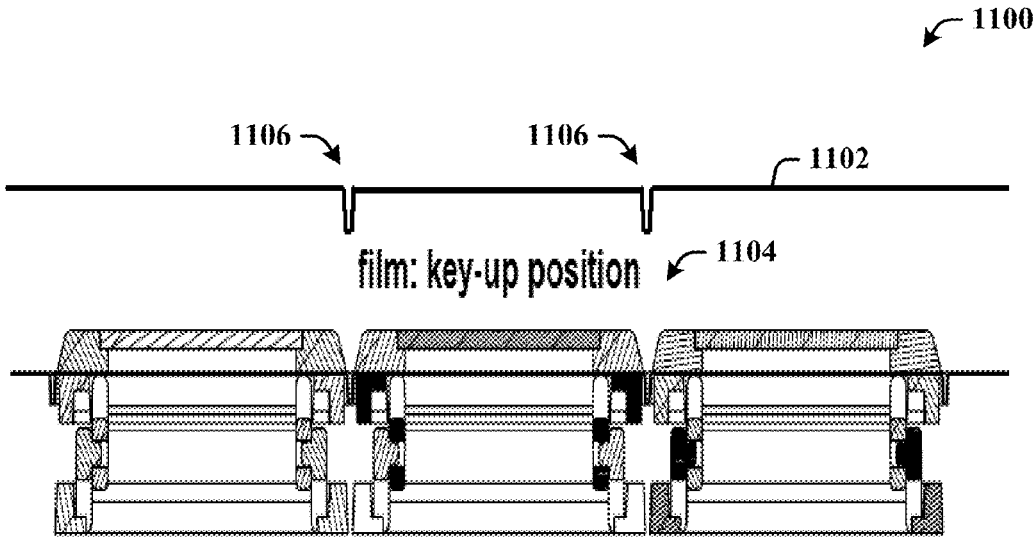
FIG. 11 is a cross section view of a sealing film when an underlying key switch assembly is in a key button up position.

FIG. 11 illustrates a cross section view 1100 of a sealing film 1102 when an underlying key switch assembly 1104 is in a key button up position. The sealing film 1102 prevents dust, oils, liquids, etc., from entering the keyboard (or keypad) and optical area under the key assemblies. The sealing film has minute folds 1106 at the key switch site that facilitate downward pressure on the film without affecting the operation of adjacent key switch sites. Alternatively, rather than folds at each switch site, an uncut sheet can cover the entire keyboard switch sites below the movable portions of the key.

Figure 12:
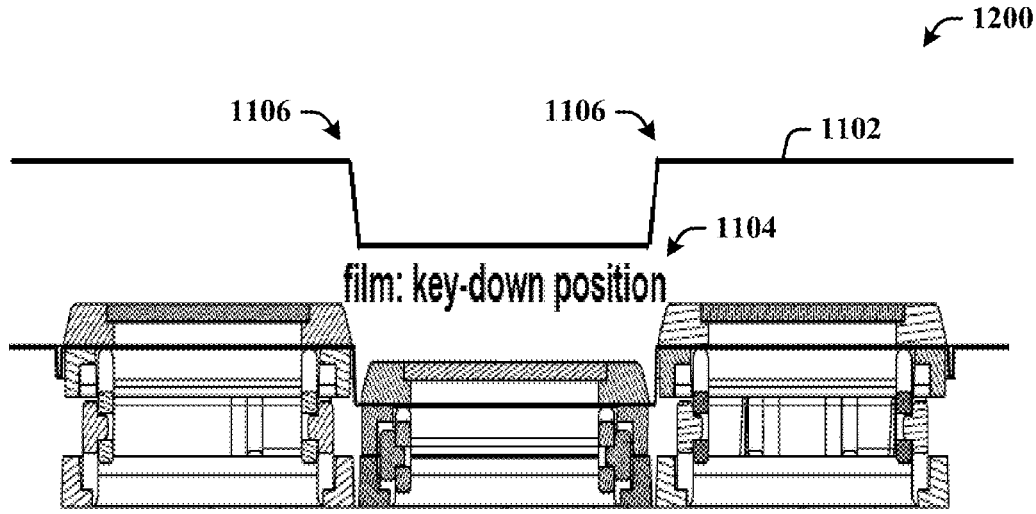
FIG. 12 is a cross section view of the sealing film architecture when the underlying key switch assembly is in a key button down position.

FIG. 12 illustrates a cross section view 1200 of the sealing film architecture 1102 when the underlying key switch assembly 1104 is in a key button down position. Here, the minute folds 1106 of the sealing film 1102 are fully expressed as the key button is pressed in the down position.

Figure 13:
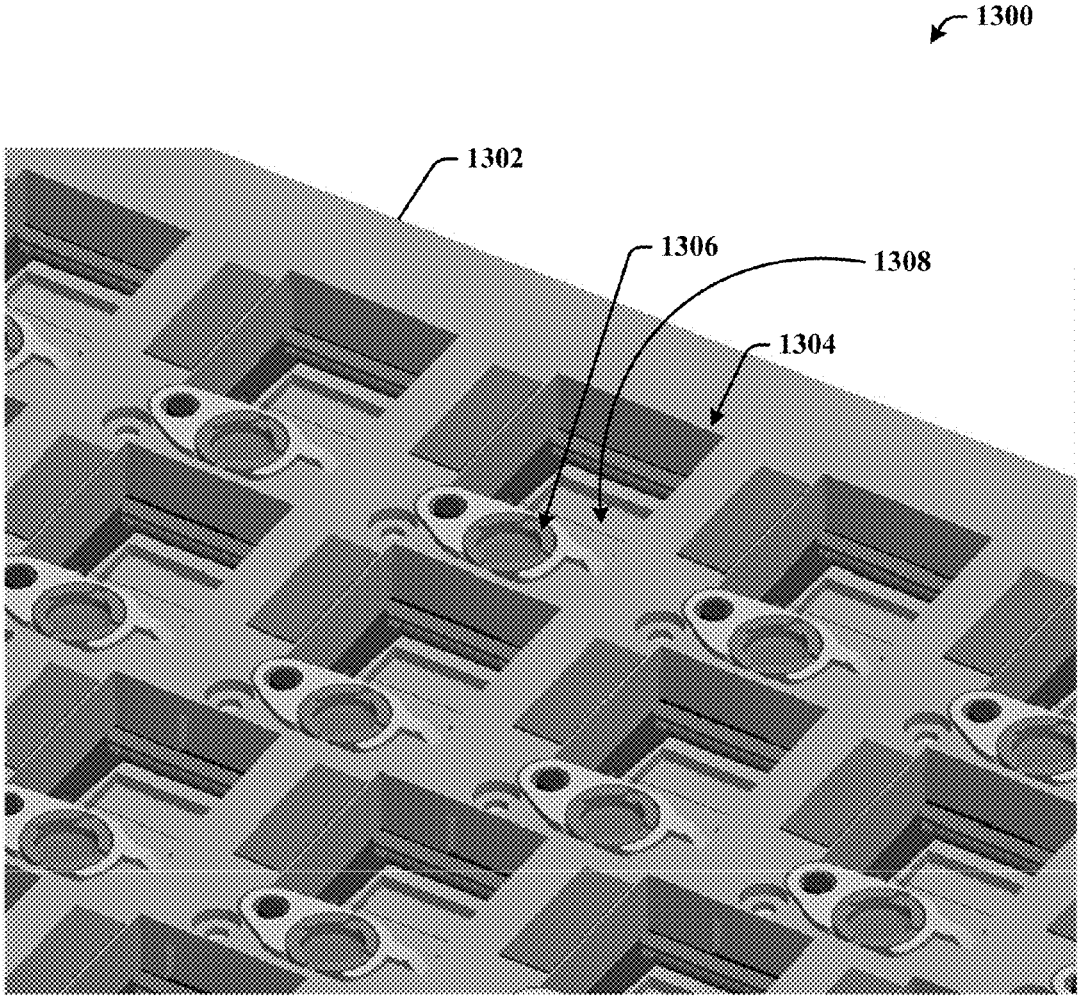
FIG. 13 is an oblique view of key sites tiled across a keyboard.

FIG. 13 illustrates an oblique view 1300 of key sites tiled across a keyboard 1302. For example, a key site 1304 includes a dome assembly 1306 outside an aperture 1308. The key site 1304 includes the scissor movement assembly and offset dome mechanical architecture. This particular embodiment utilizes an elastomeric dome for tactile feedback which is offset from its usual position in conventional emplacements under the key center, to one edge not containing the scissor pivots. The dome assembly 1306 is located in a position that allows a common tiling scheme where identical key architecture features are used for all square keys in all rows, despite the spacing differences between the rows. This leverages all possible space and allows the key display area to be as large as possible.

As shown, three sides of each key encroach into the adjacent key area. The dome assembly is between the upper and the lower key. The dome assembly extends beyond the edge of its key site into the neighboring key site. It is to be understood, however, that other implementations for locating the dome assembly can be employed, such as on the right of the key assembly, for example.

Figure 14:
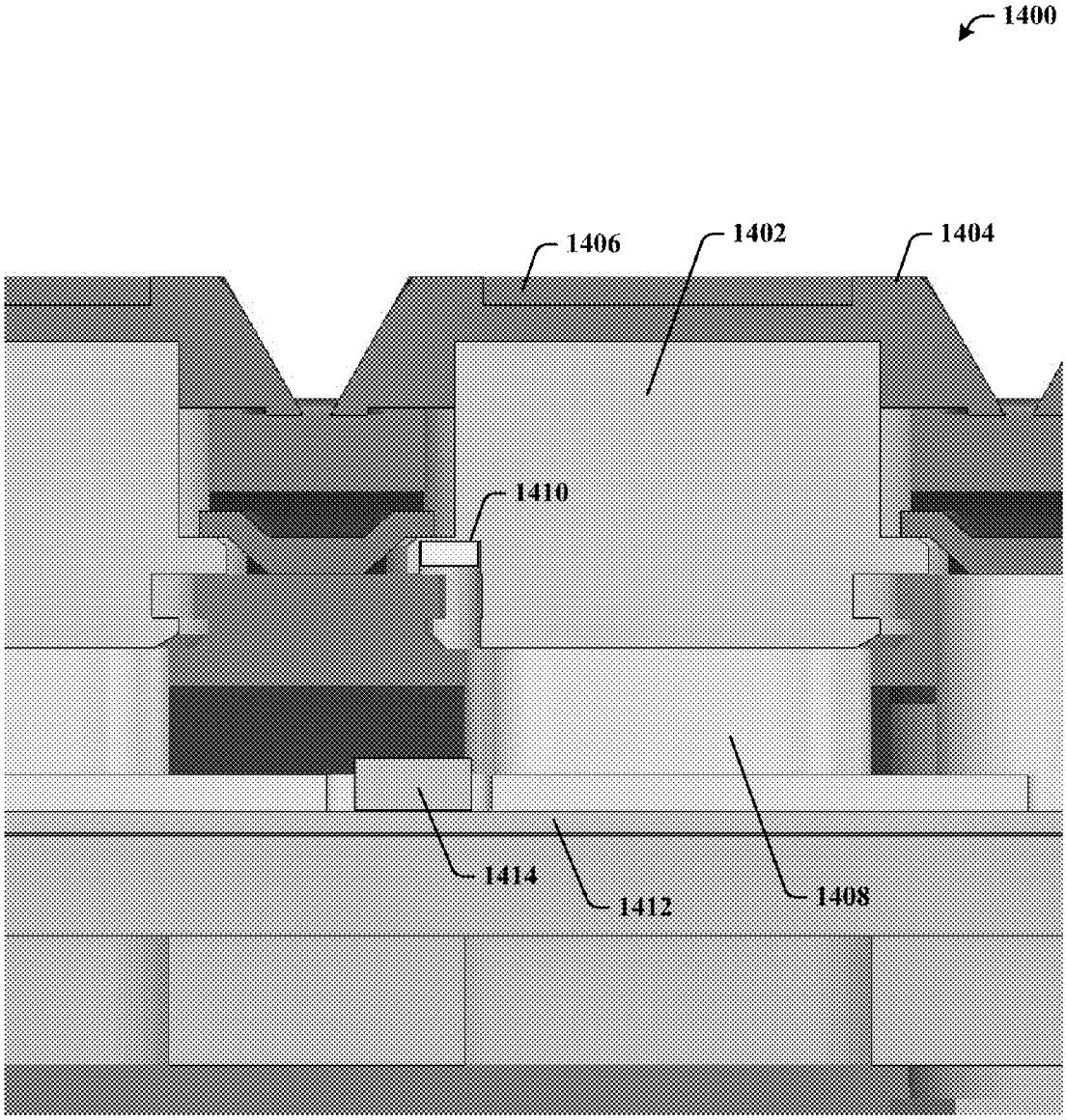
FIG. 14 illustrates a cross-section of a magnetic switching mechanism in an up position.

FIG. 14 illustrates a cross-section of a magnetic switch mechanism 1400 in an up position. The switch mechanism 1400 includes a key sleeve 1402 that is attached to a key top 1404, which includes a display window 1406. The key sleeve 1402 slides up and down a key support 1408. Associated with the key sleeve 1402 is a small magnet 1410 the effects of which are detected when the key sleeve 1402 is in a down position. A printed circuit board 1412 includes a Hall Effect sensor 1414 mounted such that when the key top 1404 is pressed downward, the magnet 1410 approaches the Hall Effect sensor 1414, which changes its voltage output depending on magnetic field. The outputs of all Hall Effect sensors for the multiple keys can be fed through a multiplexer, and then through a comparator. If the voltage is above a certain threshold, the key is considered "switched." This arrangement (with the multiplexer) allows rapid scanning of the key matrix, and also reduces the number of analog components (the comparator) necessary. An elastomeric dome is not shown, for clarity.

Figure 15:
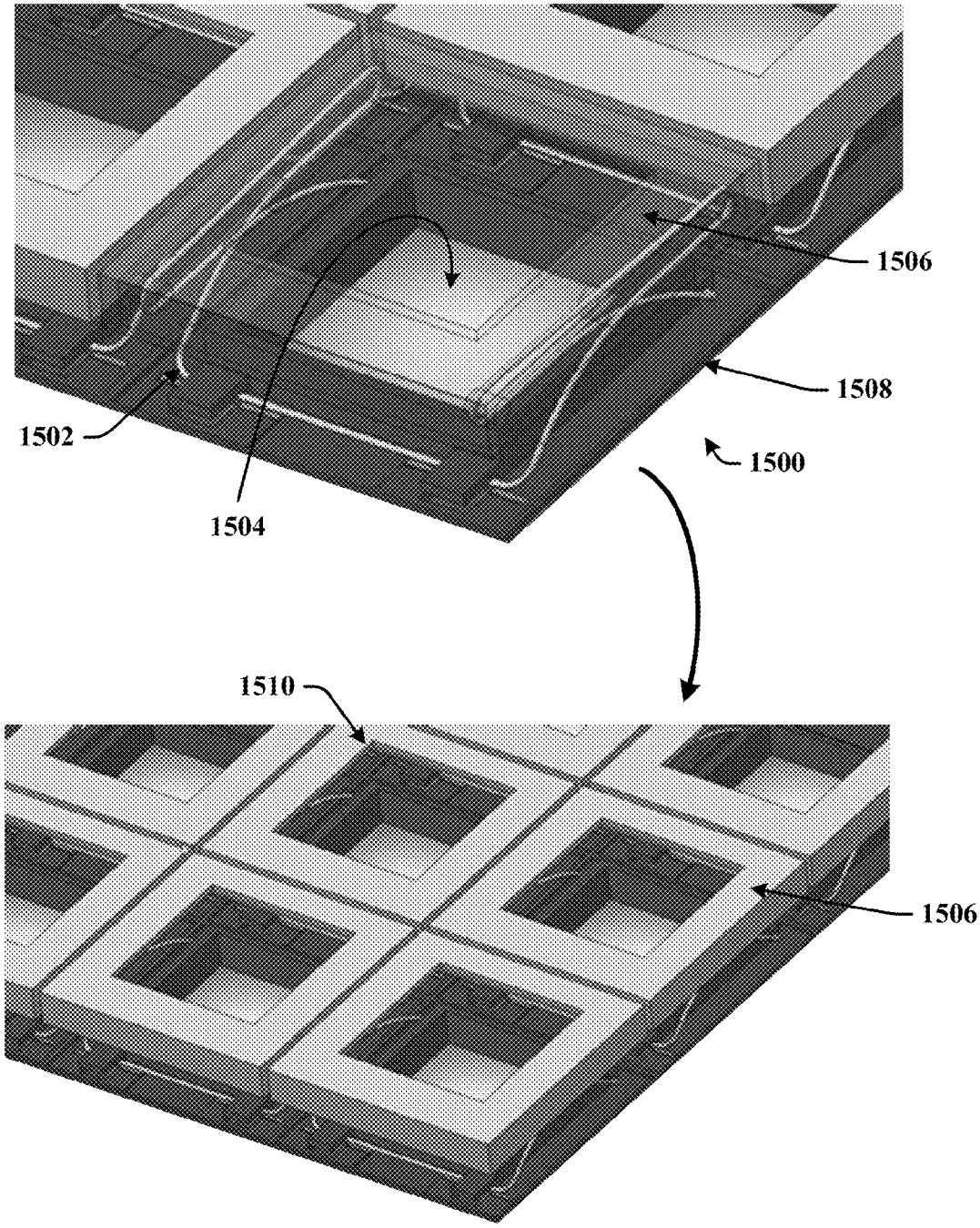
FIG. 15 illustrates an oblique view of an alternative embodiment movement assembly that employs wire formed springs.

FIG. 15 illustrates an oblique view of an alternative embodiment movement assembly 1500 that employs wire formed springs 1502. As shown, the wire formed springs 1502 provide minimal space and multi-force spring rates. Here, the movement assembly 1500 includes two wire formed springs 1502 positioned on outside an aperture 1504 through which light is directed to a window (not labeled, but positioned over the aperture 1504) located in a key button 1506 (shown transparently in the top view for more clear viewing of the internal structures, and opaquely in the bottom view). Each of the springs 1502 is captured on a base 1508 and in the inside of the key button 1506. The movement assembly 1500 is part of a key site 1510, which is duplicated many times based on the application (e.g., keyboard, keypad, etc.).

Figure 16:
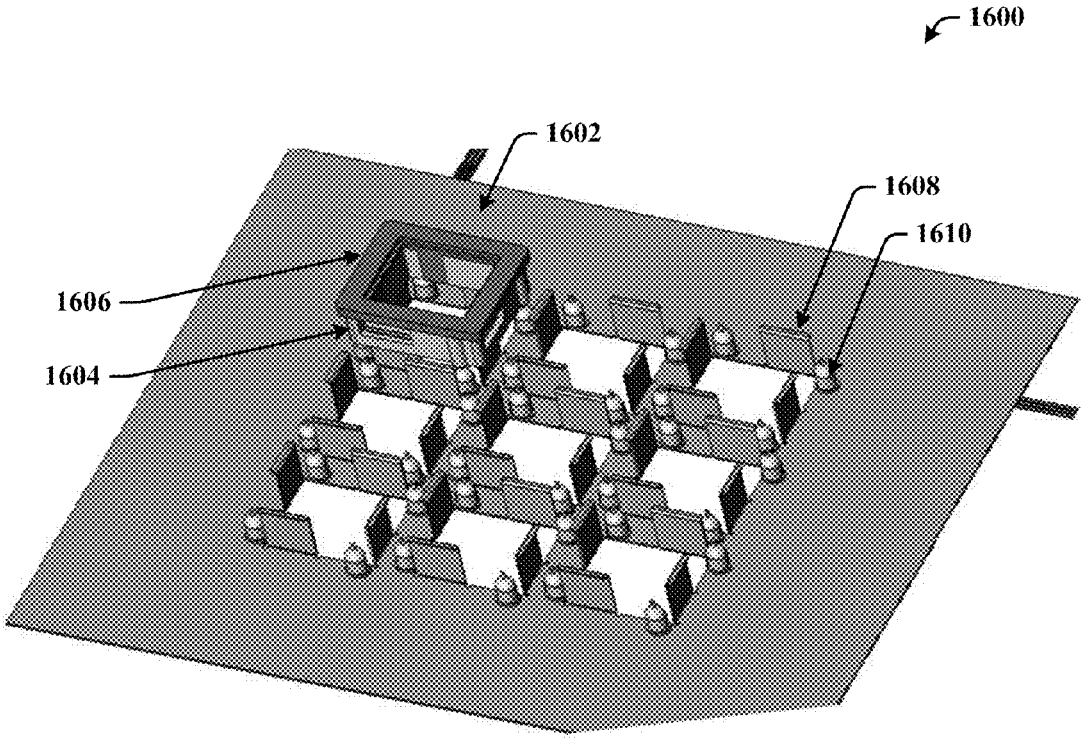
FIG. 16 illustrates an oblique view of a sheet metal rubber dome assembly.

FIG. 16 illustrates a sheet metal rubber dome assembly 1600. A key site 1602 includes a key cap base 1604, a key cap top 1606, and a diffuser (not visible) in the key cap top 1606. Downward travel is restricted equally by using four tabs 1608 (it is to be understood that a different number of tabs can also be employed). The spring function is provided by four silicone buckling elements 1610 (it is to be understood that a different number of elements can also be employed). The spring rate is dependent on the silicone buckling element design.

Figure 17:
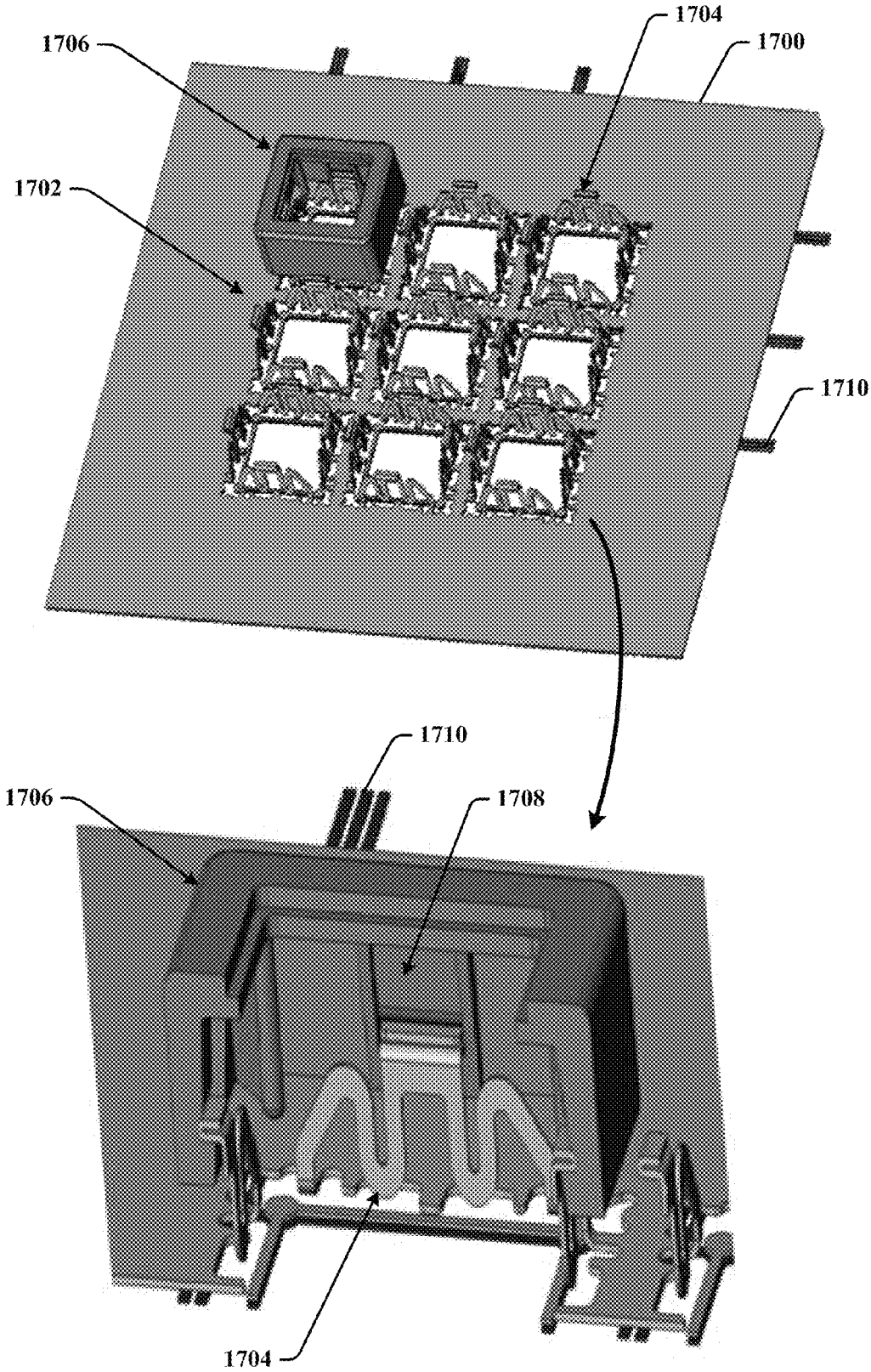
FIG. 17 illustrates a keypad where each key site employs a movement assembly in the form of metal springs for the spring function.

FIG. 17 illustrates a keypad 1700 where each key site 1702 employs a movement assembly in the form of metal springs 1704 for the spring function. Here, the keypad 1700 includes nine key sites. Each key site 1702 includes four formed metal springs 1704 (e.g., stainless steel), a key cap base 1706, and a diffuser (not visible) that fits into the top of the key cap base 1706. It is to be understood that a different number of springs can also be employed. The key cap base 1706 snaps into the movement assembly. The spring rate is 2-stage using key cap ramps. Conductors 1710 facilitate sensing of the switch state at each key site 1702.

Figure 18:
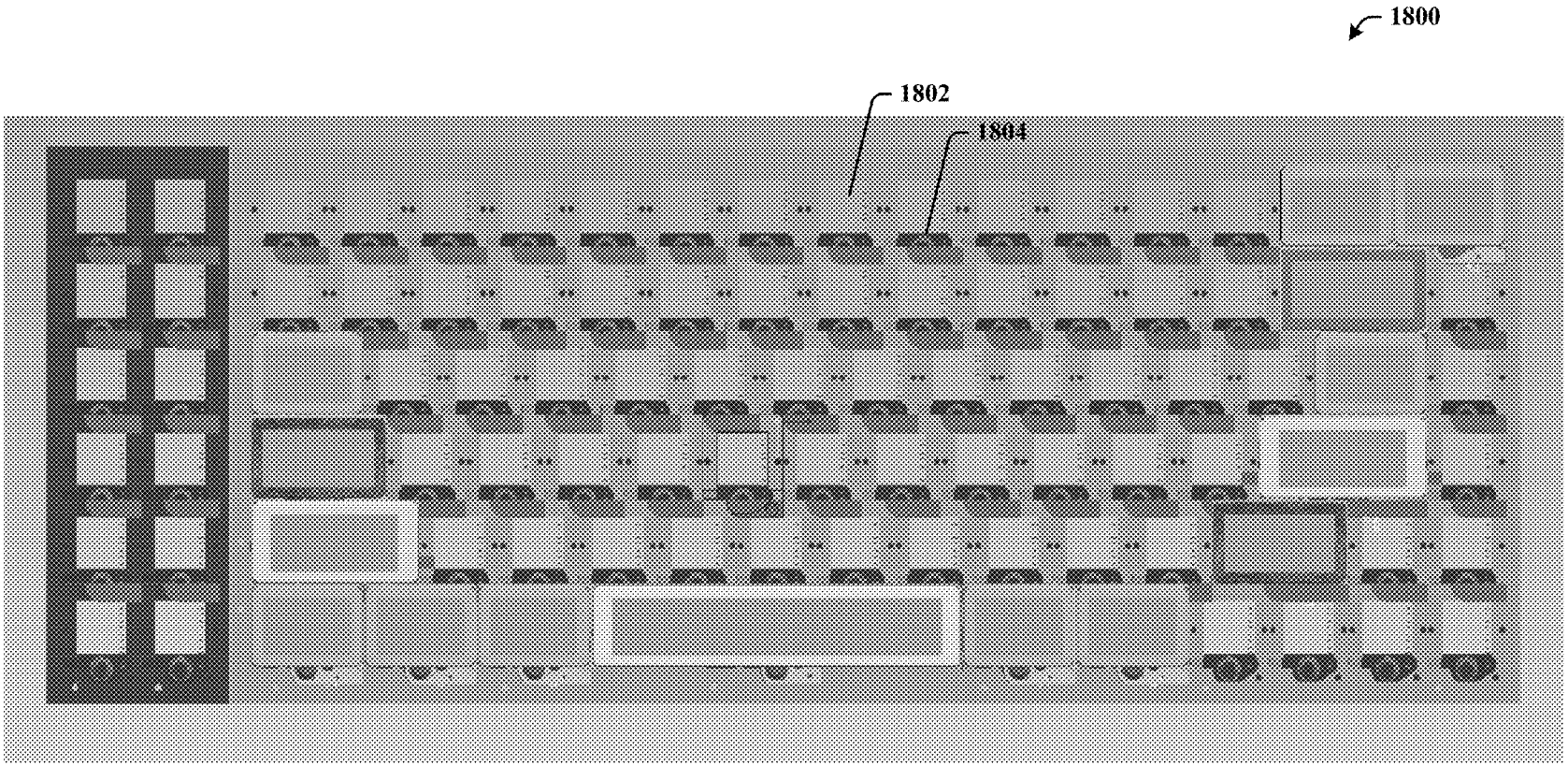
FIG. 18 is a top-down view of a key tiling pattern-dome placement between rows.

FIG. 18 illustrates a top-down view 1800 of a key tiling pattern-dome placement between rows. This allows identical keys 1802 to be tiles across all rows, with the domes 1804 located outside of the aperture for key button image viewing.

In other words, the feedback assembly includes a flexible dome that is offset from the aperture and which provides the tactile feedback. The flexible dome can include an optical marker that is sensed when the key button is in a down position. Alternatively, the flexible dome can extends through one or more flexible substrates when compressed to close a switch contact that indicates the key button 206 is in a down position.

The movement assembly can include the contact arm 218 affixed thereto. The contact arm 218 is sensed to determine position of the key button 206. The contact arm 218 can include an optically detectable surface (the pad 220) that is sensed when the key button 206 is in a down position. In one implementation, the movement assembly includes scissor structures (the scissor-type movement assembly 208) that cooperate to facilitate vertical movement of the key button 206. The scissor structures are located on opposing sides of the aperture and through which the light is projected onto the display portion. The scissor structure can includes an optical paddle the position of which indicates position of the key button. This is illustrated herein below. Alternatively, the movement assembly includes a hollow key stem in a key silo that facilitates vertical movement of the key button 206. The hollow key stem and silo allow light through for projection onto the display portion.

In another embodiment, a key switch assembly comprises the key button having a display area on which an image is presented, the movement assembly in contact with the key button for facilitating movement of the key button, the movement assembly defining an aperture through which the image is projected onto the display area, and the tactile feedback assembly offset from the movement assembly for providing tactile feedback.

The tactile feedback assembly can include an elastomeric dome that provides the tactile feedback. The elastomeric dome includes an optical marker that is sensed via an optical surface when the key button is in a down position. The movement assembly can include a switch post (contact arm 218) affixed thereto. The switch post can include an optically detectable surface that is sensed when the key button is in a down position. Note that alternative tactile feedback devices can be employed in place of the elastomeric dome, as previously mentioned.

In one embodiment, the movement assembly includes a scissor structure located in the periphery of the switch assembly and that operates under movement of the key button. An aperture is defined (formed) through the scissor structure and via which the image is projected onto the display area.

In another embodiment, the movement assembly includes a hollow key stem attached to the key button. The key stem operates in cooperation with the key silo during movement of the key button. An aperture is formed (defined) through the key stem and silo to allow presentation of the image onto the display area.

Included herein is a set of flow charts representative of exemplary methodologies for performing novel aspects of the disclosed architecture. While, for purposes of simplicity of explanation, the one or more methodologies shown herein, for example, in the form of a flow chart or flow diagram, are shown and described as a series of acts, it is to be understood and appreciated that the methodologies are not limited by the order of acts, as some acts may, in accordance therewith, occur in a different order and/or concurrently with other acts from that shown and described herein. For example, those skilled in the art will understand and appreciate that a methodology could alternatively be represented as a series of interrelated states or events, such as in a state diagram. Moreover, not all acts illustrated in a methodology may be required for a novel implementation.

Figure 19:
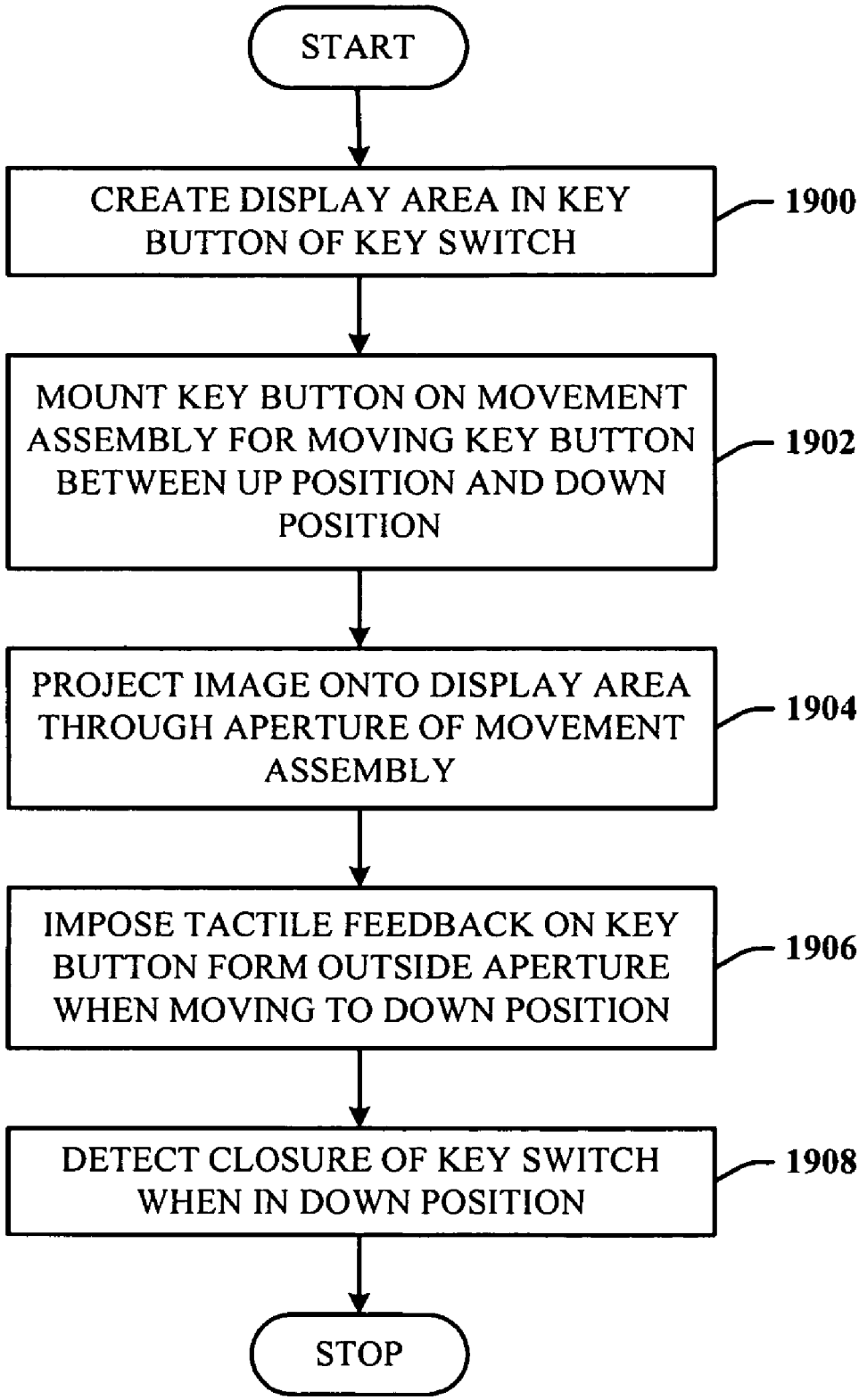
FIG. 19 illustrates a method of providing a key switch with a display area.

FIG. 19 illustrates a method of providing a key switch. At 1900, a display area is created in a key button of a key switch. At 1902, the key button is mounted on a movement assembly for moving the key button between an up position and a down position. At 1904, an image is projected onto the display area through an aperture of the movement assembly. At 1906, tactile feedback is imposed on the key button from outside the aperture when moving to the down position. At 1908, closure of the key switch is detected when in the down position. The method can further comprise projecting the image using an optical lens on which the key switch is positioned. The method can further comprise affixing a contact arm to the key button and optically detecting the down position based on a reflective end of the contact arm, or affixing an optical paddle to the movement assembly and optically detecting the down position based on a reflective pad or portion of the optical paddle. The movement assembly can be a scissor structure through which the image is projected onto the display area. Alternatively, the movement assembly can be a stem-silo structure through which the image is projected onto the display area.

As previously indicated, an additional embodiment may use stamped sheet metal in a horizontal orientation where four interior quarters of a square hole for each key are bent ninety degrees vertically upward, providing guides for a plastic key with slots to travel vertically, similar to a stem/silo design. Other architectures similar to this one are possible by using different materials, such as making the base out of molded plastic rather than stamped sheet metal, or making the key tops or scissor parts out of metal instead of plastic. Many unique embodiments are possible.

The word "exemplary" may be used herein to mean serving as an example, instance, or illustration. Any aspect or design described herein as "exemplary" is not necessarily to be construed as preferred or advantageous over other aspects or designs.

Figure 20:
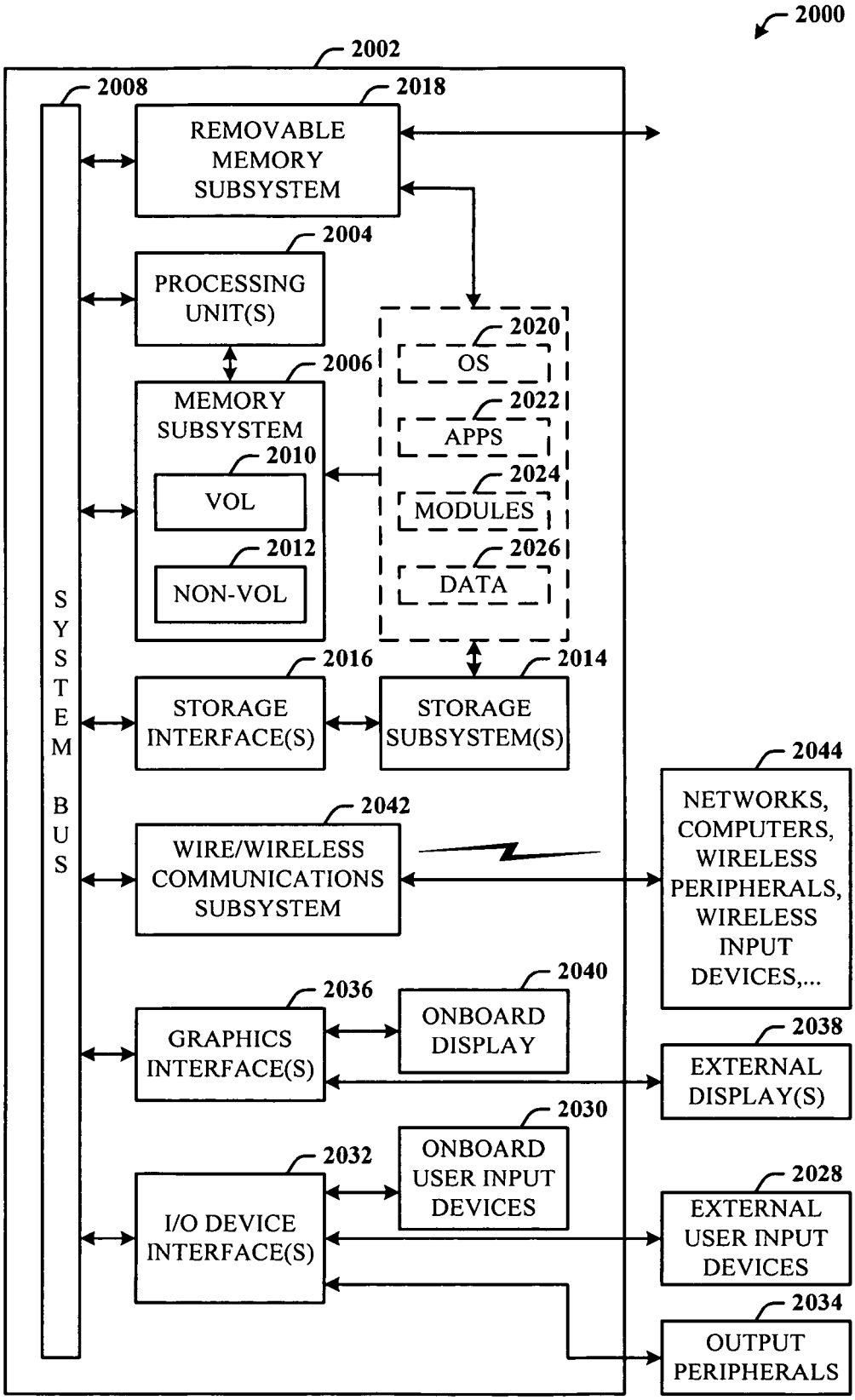
FIG. 20 illustrates a block diagram of a computing system operable to interface to a keyboard that employs the key switch assembly of the disclosed mechanical architecture.

Referring now to FIG. 20, there is illustrated a block diagram of a computing system 2000 operable to interface to a keyboard that employs the key switch assembly of the disclosed mechanical architecture. In order to provide additional context for various aspects thereof, FIG. 20 and the following discussion are intended to provide a brief, general description of the suitable computing system 2000 in which the various aspects can be implemented. While the description above is in the general context of computer-executable instructions that can run on one or more computers, those skilled in the art will recognize that a novel embodiment also can be implemented in combination with other program modules and/or as a combination of hardware and software. For example, the keyboard itself may contain a microcontroller or processing unit, internal memory and an embedded operating system, etc. Alternatively, the external computing system may be a mobile phone or other mobile computing system. Still alternatively, the external computing system may be a mini-computer, mainframe, or supercomputer. A greater variety in components, computing architecture, mobility, control, and form factor is possible.

The computing system 2000 for implementing various aspects includes the computer 2002 having processing unit(s) 2004, a system memory 2006, and a system bus 2008. The processing unit(s) 2004 can be any of various commercially available processors such as single-processor, multi-processor, single-core units and multi-core units. Moreover, those skilled in the art will appreciate that the novel methods can be practiced with other computer system configurations, including minicomputers, mainframe computers, as well as personal computers (e.g., desktop, laptop, etc.), hand-held computing devices, microprocessor-based or programmable consumer electronics, and the like, each of which can be operatively coupled to one or more associated devices.

The system memory 2006 can include volatile (VOL) memory 2010 (e.g., random access memory (RAM)) and non-volatile memory (NON-VOL) 2012 (e.g., ROM, EPROM, EEPROM, etc.). A basic input/output system (BIOS) can be stored in the non-volatile memory 2012, and includes the basic routines that facilitate the communication of data and signals between components within the computer 2002, such as during startup. The volatile memory 2010 can also include a high-speed RAM such as static RAM for caching data.

The system bus 2008 provides an interface for system components including, but not limited to, the memory subsystem 2006 to the processing unit(s) 2004. The system bus 2008 can be any of several types of bus structure that can further interconnect to a memory bus (with or without a memory controller), and a peripheral bus (e.g., PCI, PCIe, AGP, LPC, etc.), using any of a variety of commercially available bus architectures.

The computer 2002 further includes storage subsystem(s) 2014 and storage interface(s) 2016 for interfacing the storage subsystem(s) 2014 to the system bus 2008 and other desired computer components. The storage subsystem(s) 2014 can include one or more of a hard disk drive (HDD), a magnetic floppy disk drive (FDD), and/or optical disk storage drive (e.g., a CD-ROM drive DVD drive), for example. The storage interface(s) 2016 can include interface technologies such as EIDE, ATA, SATA, and IEEE 1394, for example.

One or more programs and data can be stored in the memory subsystem 2006, a removable memory subsystem 2018 (e.g., flash drive form factor technology), and/or the storage subsystem(s) 2014, including an operating system 2020, one or more application programs 2022, other program modules 2024, and program data 2026. Generally, programs include routines, methods, data structures, other software components, etc., that perform particular tasks or implement particular abstract data types. All or portions of the operating system 2020, applications 2022, modules 2024, and/or data 2026 can also be cached in memory such as the volatile memory 2010, for example. It is to be appreciated that the disclosed architecture can be implemented with various commercially available operating systems or combinations of operating systems (e.g., as virtual machines).

The storage subsystem(s) 2014 and memory subsystems (2006 and 2018) serve as computer readable media for volatile and non-volatile storage of data, data structures, computer-executable instructions, and so forth. Computer readable media can be any available media that can be accessed by the computer 2002 and includes volatile and non-volatile media, removable and non-removable media. For the computer 2002, the media accommodate the storage of data in any suitable digital format. It should be appreciated by those skilled in the art that other types of computer readable media can be employed such as zip drives, magnetic tape, flash memory cards, cartridges, and the like, for storing computer executable instructions for performing the novel methods of the disclosed architecture.

A user can interact with the computer 2002, programs, and data using external user input devices 2028 such as a keyboard and a mouse. Other external user input devices 2028 can include a microphone, an IR (infrared) remote control, a joystick, a game pad, camera recognition systems, a stylus pen, touch screen, gesture systems (e.g., eye movement, head movement, etc.), and/or the like. The user can interact with the computer 2002, programs, and data using onboard user input devices 2030 such a touchpad, microphone, keyboard, etc., where the computer 2002 is a portable computer, for example. These and other input devices are connected to the processing unit(s) 2004 through input/output (I/O) device interface(s) 2032 via the system bus 2008, but can be connected by other interfaces such as a parallel port, IEEE 1394 serial port, a game port, a USB port, an IR interface, etc. The I/O device interface(s) 2032 also facilitate the use of output peripherals 2034 such as printers, audio devices, camera devices, and so on, such as a sound card and/or onboard audio processing capability.

One or more graphics interface(s) 2036 (also commonly referred to as a graphics processing unit (GPU)) provide graphics and video signals between the computer 2002 and external display(s) 2038 (e.g., LCD, plasma) and/or onboard displays 2040 (e.g., for portable computer). The graphics interface(s) 2036 can also be manufactured as part of the computer system board.

The computer 2002 can operate in a networked environment (e.g., IP) using logical connections via a wired/wireless communications subsystem 2042 to one or more networks and/or other computers. The other computers can include workstations, servers, routers, personal computers, microprocessor-based entertainment appliance, a peer device or other common network node, and typically include many or all of the elements described relative to the computer 2002. The logical connections can include wired/wireless connectivity to a local area network (LAN), a wide area network (WAN), hotspot, and so on. LAN and WAN networking environments are commonplace in offices and companies and facilitate enterprise-wide computer networks, such as intranets, all of which may connect to a global communications network such as the Internet.

When used in a networking environment the computer 2002 connects to the network via a wired/wireless communication subsystem 2042 (e.g., a network interface adapter, onboard transceiver subsystem, etc.) to communicate with wired/wireless networks, wired/wireless printers, wire/wireless input devices 2044, and so on. The computer 2002 can include a modem or has other means for establishing communications over the network. In a networked environment, programs and data relative to the computer 2002 can be stored in the remote memory/storage device, as is associated with a distributed system. It will be appreciated that the network connections shown are exemplary and other means of establishing a communications link between the computers can be used.

The computer 2002 is operable to communicate with wired/wireless devices or entities using the radio technologies such as the IEEE 802.xx family of standards, such as wireless devices operatively disposed in wireless communication (e.g., IEEE 802.11 over-the-air modulation techniques) with, for example, a printer, scanner, desktop and/or portable computer, personal digital assistant (PDA), communications satellite, any piece of equipment or location associated with a wirelessly detectable tag (e.g., a kiosk, news stand, restroom), and telephone. This includes at least Wi-Fi (or Wireless Fidelity) for hotspots, WiMax, and Bluetooth™ wireless technologies. Thus, the communications can be a predefined structure as with a conventional network or simply an ad hoc communication between at least two devices. Wi-Fi networks use radio technologies called IEEE 802.11x (a, b, g, etc.) to provide secure, reliable, fast wireless connectivity. A Wi-Fi network can be used to connect computers to each other, to the Internet, and to wire networks (which use IEEE 802.3-related media and functions).

What has been described above includes examples of the disclosed architecture. It is, of course, not possible to describe every conceivable combination of components and/or methodologies, but one of ordinary skill in the art may recognize that many further combinations and permutations are possible. Accordingly, the novel architecture is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A key switch assembly, comprising:

a key button having a display portion;

a movement assembly in contact with the key button and positioned on an optical surface that transmits light up from the optical surface, the movement assembly facilitating vertical movement of the key button between an up position and a down position and defining an aperture through which light transmitted by the optical surface is projected onto the display portion of the key button; and a feedback assembly in contact with the movement assembly and positioned on the optical surface, the feedback assembly providing tactile feedback for the key button from outside the aperture when the key button is moved to the down position, wherein at least one of the key button, the movement assembly, and the feedback assembly provides a reflective surface to reflect light transmitted by the optical surface for sensing the up position and down position of the key button.

2. The assembly of claim 1, wherein the feedback assembly includes a flexible dome which provides the tactile feedback.

3. The assembly of claim 2, wherein the flexible dome includes an optical marker which provides the reflective surface.

4. The assembly of claim 2, wherein the flexible dome extends through one or more flexible substrates when compressed to close a switch contact when the key button is in the down position.

5. The assembly of claim 1, further comprising a contact arm affixed to one of the key button and the movement assembly, the contact arm providing the reflective surface.

6. The assembly of claim 5, wherein the contact arm contacts the optical surface when the key button is in the down position.

7. The assembly of claim 1, wherein the movement assembly includes scissor structures that cooperate to facilitate the vertical movement of the key button, the scissor structures being on opposing sides of the aperture through which light transmitted by the optical surface is projected onto the display portion of the key button.

8. The assembly of claim 7, wherein the scissor structure includes an optical paddle which provides the reflective surface.

9. The assembly of claim 1, wherein the movement assembly includes a hollow key stem in a silo that facilitates vertical movement of the key button, the hollow key stem and silo defining the aperture through which light transmitted by the optical surface is projected onto the display portion of the key button.

10. A key switch assembly, comprising:

a key button of a keyboard for a computer, the key button having a display area on which an image is presented;

a movement assembly in contact with the key button and positioned on an optical surface that projects the image, the movement assembly facilitating movement of the key button between an up position and a down position and defining an aperture through which the image is projected by the optical surface onto the display area of the key button; and a tactile feedback assembly in contact with the movement assembly and positioned on the optical surface, the tactile feedback assembly providing tactile feedback for the key button from outside the aperture when the key button is moved to the down position, wherein at least one of the key button, the movement assembly, and the tactile feedback assembly provides a reflective surface to reflect light transmitted up from the optical surface for sensing the up position and down position of the key button.

11. The assembly of claim 10, wherein the tactile feedback assembly includes an elastomeric dome that provides the tactile feedback, the elastomeric dome including an optical marker which provides the reflective surface.

12. The assembly of claim 10, wherein at least one the key button and the movement assembly includes a contact arm affixed thereto, the contact arm providing the reflective surface.

13. The assembly of claim 10, wherein the movement assembly includes a scissor structure that is located in the periphery of the switch assembly and that operates under movement of the key button, the scissor structure defining the aperture through which the image is projected by the optical surface onto the display area of the key button.

14. The assembly of claim 10, wherein the movement assembly includes a hollow key stem attached to the key button, the key stem operating in cooperation with a silo during movement of the key button, the key stem and silo defining the aperture through which the image is projected by the optical surface onto the display area of the key button.

15. A method performed in a key switch assembly, the method comprising:

transmitting light up from an optical surface onto a display area of a key button of the key switch assembly, the key button mounted on a movement assembly for moving the key button between an up position and a down position, the movement assembly positioned on the optical surface and defining an aperture through which light transmitted by the optical surface is projected onto the display area of the key button;

providing tactile feedback for the key button from outside the aperture when the key button is moved to the down position via a feedback assembly in contact with the movement assembly and positioned on the optical surface; and reflecting light transmitted by the optical surface for sensing the up position and down position of the key button via a reflective surface provided by at least one of the key button, the movement assembly and the feedback assembly.

16. The method of claim 15, further comprising presenting an image on the display area of the key button.

17. The method of claim 15, wherein at least one of the key button and the movement assembly includes a contact arm which provides the reflective surface.

18. The method of claim 15, wherein the movement assembly includes an optical paddle which provides the reflective surface.

19. The method of claim 15, wherein the movement assembly is a scissor structure that defines the aperture through which light transmitted by the optical surface is projected onto the display area of the key button.

20. The method of claim 15, wherein the movement assembly is a stem-silo structure that defines the aperture through which light transmitted by the optical surface is projected onto the display area of the key button.

* * * * *